United States Patent [19]

Van Der Linden

[11] 4,344,647

[45] Aug. 17, 1982

[54] EXTERIOR OPERATING ARRANGEMENT FOR EMERGENCY EXIT DOORS WITH DELAYED OPENING FEATURE

[75] Inventor: Roy E. Van Der Linden, New Windsor, Md.

[73] Assignee: Reliable Security Systems, Inc., Cockeysville, Md.

[21] Appl. No.: 160,025

[22] Filed: Jun. 16, 1980

[51] Int. Cl.[3] ..... E05C 15/02

[52] U.S. Cl. ..... 292/201

[58] Field of Search ..... 292/78, 79, 92, 93, 292/192, 201, 144, 209, DIG. 65; 340/542; 70/267, 268, 270

[56] References Cited

U.S. PATENT DOCUMENTS

| | | | |
|---|---|---|---|
| 184,297 | 11/1876 | Potter | 70/267 |
| 1,989,419 | 1/1935 | Hill | 70/26 |
| 3,122,388 | 2/1964 | Powers | 292/341.16 |

*Primary Examiner*—Richard E. Moore

*Attorney, Agent, or Firm*—Quaintance & Murphy

[57] ABSTRACT

An emergency exit door lock equipped with a delay is provided with exterior unlatching and unlocking arrangements which permit a door normally locked with respect to the outside to have a bolt which is undogged and retracted from the outside. Upon undogging the bolt from the outside, the delay is deactivated by de-energizing a solenoid which controls application of the delay.

8 Claims, 8 Drawing Figures

EXTERIOR OPERATING ARRANGEMENT FOR EMERGENCY EXIT DOORS WITH DELAYED OPENING FEATURE

BACKGROUND OF THE INVENTION

1. Field of the Invention

This invention relates to emergency exit door latches, and more particularly, this invention relates to exterior locks and operators for emergency exit door latches.

2. Background of the Invention

It is frequently desirable to provide emergency exit doors with latching means that can be locked and unlocked from the outside so that access can be selectively controlled from the outside while egress remains unaffected or can be controlled from the inside.

U.S. Pat. application Ser. No. 22,110, filed Mar. 20, 1979, discloses an emergency exit door latching and locking apparatus which includes a closure retracted latch bolt that is dogged in the projected position by a toggle linkage. When the toggle linkage is pushed overcenter by a panic bar, the bolt is undogged and the door will open when pushed upon. In U.S. Pat. No. 22,110, the toggle linkage is connected to a hydraulic delay which retards retraction of the bolt so as to hold the person trying to gain egress at the door for a predetermined period of time as an alarm rings. If there is an emergency situation, the hydraulic circuit loading the toggle linkage is opened by de-energizing a solenoid which closes a normally open valve in the circuit, thereby permitting immediate retraction of the bolt and opening of the door.

The emergency exit door lock and latch disclosed in U.S. Pat. No. 22,110 cannot be operated or opened from the outside because prior to the invention which is the subject of that patent application, the particular problem of operating such a lock and latch from the outside did not exist. There are additional considerations which must be taken into account due to the delay means, such as, deactivation of the delay circuit and selective deactivation of the alarm.

SUMMARY OF THE INVENTION

It is a feature of the instant invention to provide exteriorly operated locking and unlocking hardware and exteriorly operated unlatching hardware for the type of emergency exit door lock and latch disclosed in U.S. Pat. Ser. No. 22,110, filed Mar. 20, 1979.

In view of the aforementioned feature, the instant invention contemplates locking hardware which provides for locking and exterior operation of the aforedescribed lock and latch in which a latch bolt is held projected by a toggle linkage which dogs the latch bolt in the projected position when in a dogging mode and undogs the latch bolt when in an overcenter undogging mode. In accordance with the invention, a sliding link is positioned in engagement with the toggle linkage for shifting the toggle linkage from the dogged mode to the undogged mode upon sliding from the first position to a second position. A bell crank has one arm connected to the slider for moving the slider from the first position to the second position upon rotating the other arm of the bell crank and an interposer is positioned adjacent to the other arm of the bell crank for movement in and out of alignment with the bell crank. The interposer is connected to a tumbler which is rotated by a keylock to shift the interposer in and out of alignment with the bell crank.

DESCRIPTION OF THE PREFERRED EMBODIMENT

Figure 1:
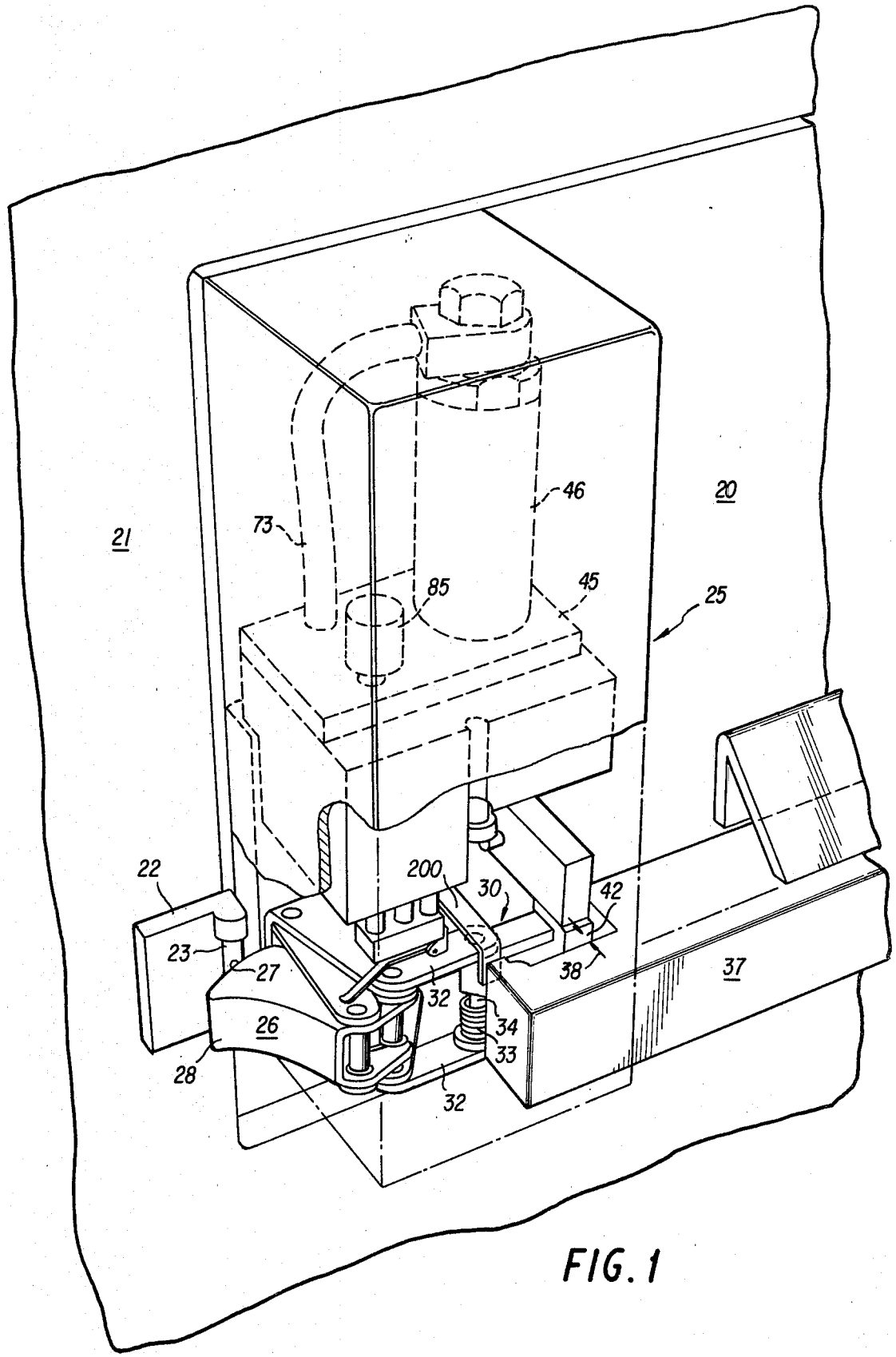
FIG. 1 is a perspective view, with portions cut away, of the type of emergency exit door latch or lock with which the instant invention is utilized.

Referring now to FIG. 1, there is shown an emergency exit door 20 mounted on hinges (not shown) to pivot with respect to a door jamb 21 on which is mounted a keeper 22 having strike 23. The door 20 has a latching and locking apparatus, designated generally by the numeral 25, similar to the locking and latching apparatus disclosed in U.S. patent application entitled "Emergency Exit Door Latching and Locking Apparatus", Ser. No. 22,110, filed Mar. 3, 1979, by Roy E. VanDerLinden and incorporated herein by reference. The locking and latching apparatus 25 controls a latch bolt 26 which when projected behind strike 23, holds the door 20 latched or locked in a first mode. The bolt 26 is closure operated in that the bolt has a first cam surface 27 thereon which urges the bolt to a retracted position when in a second mode in which the apparatus is unlatched upon pressing the door 20 so as to force the first cam surface 27 against the strike 23. When the door 20 is open, the bolt 26 is projected and when the door is thereafter closed, a second cam surface 28 on the bolt 26 engages the strike 23 to urge the bolt to the retracted position so that the bolt can project behind the strike once it clears the strike. The bolt 26 is normally "dogged" in the projected positions shown in FIG. 1 by a toggle linkage designated generally by the numeral 30. The toggle linkage 30 consists of links 31—31 and 32—32 pivotally connected to one another on a pivot pin 34 and urged by a coil spring 33, mounted coaxially on pivot pin 34 to a first position in which the bolt 26 is dogged. Upon "breaking" the toggle 30 by moving the toggle over-center toward a second position, the bolt 26 becomes undogged so that pressure on the door 20 applies the camming force to the cam surface 27 via strike 23 to thereby retract the bolt 26. The toggle 30 is broken by a push bar 37 which can move toward the door 20 by a distance 38 which is sufficient to break the toggle 30 through engaging the toggle with a projection 40 on the push bar without further pushing the toggle toward the second position in which the bolt 26 is retracted. The distance 38 is determined by a projection 41 fixed with respect to the door 10 which projection is engaged by surface 42 on the push bar 37 after the push bar 37 has been depressed to undog the bolt 26. Any force applied to the push bar 37 after the toggle linkage 30 is broken is transmitted by the projection 41 directly to the door 20 so as to cam the bolt 26 to the retracted position due to engagement between the bolt and strike 23 via surface 27 on the bolt.

Figure 2:
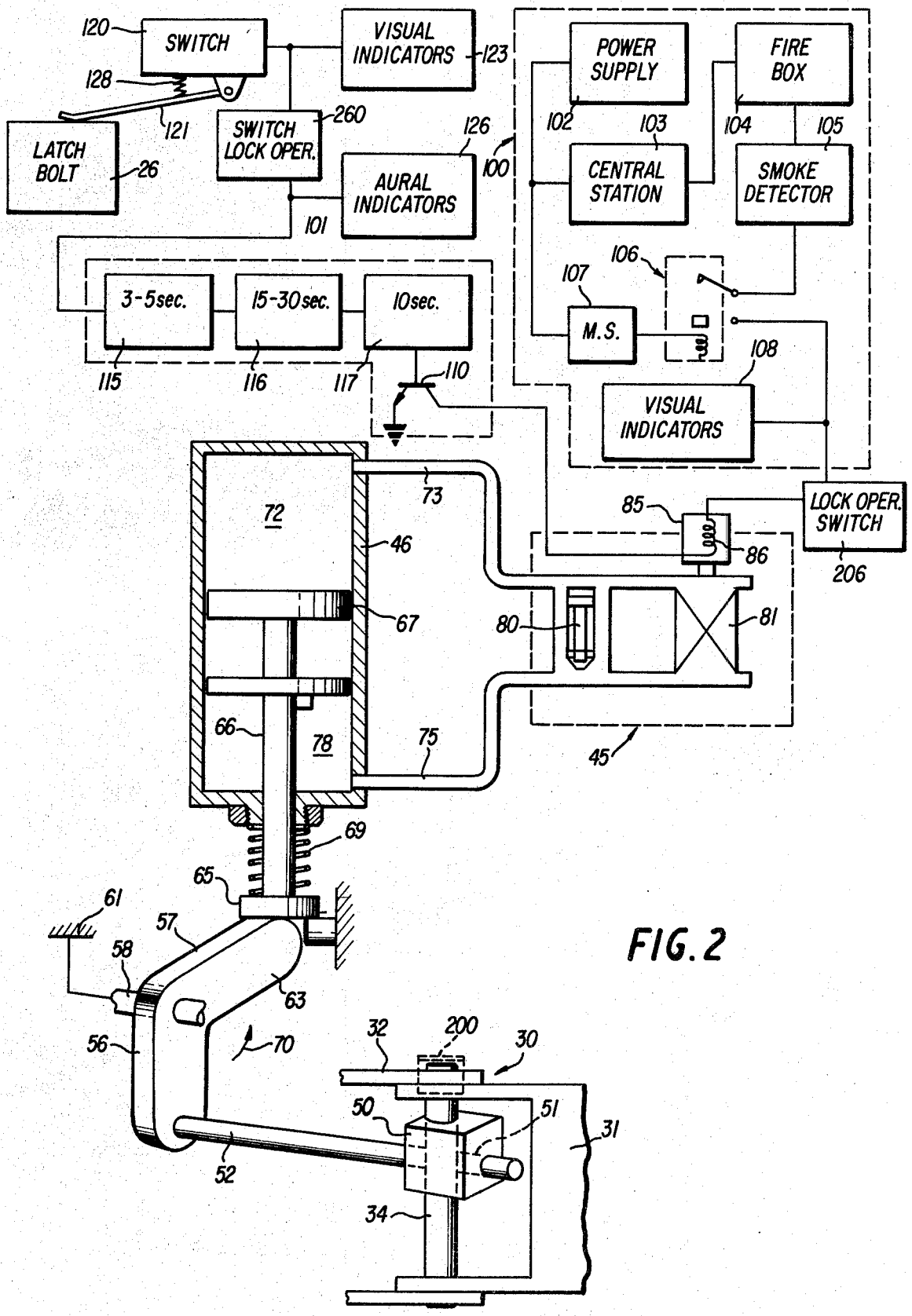
FIG. 2 is a diagrammatical view of the mechanical, hydraulic and electrical system used to delay retraction of the bolt shown in the latch of FIG. 1.

Referring now to FIG. 2 as well as FIG. 1, the force between the strike 23 and bolt 26 tending to push the bolt to its retracted position is transmitted to the toggle linkage 30 tending to collapse the toggle linkage 30 inwardly so that the pivot pin 34 moves toward the door 20. Mounted on the pivot pin 34 is a sliding block 50 which has a bore 51 therethrough which receives a rod 52. The rod 52 is rigidly connected to one arm 56 of a bell crank 57 which is mounted to pivot about a pivot 58 secured to the mounting structure 61 of the latching and locking apparatus. The bell crank 57 has a second arm 63 which engages the end 65 of a piston rod 66 which projects from a piston 67 within the cylinder 46. A spring 69 urges the end 65 of the piston rod 66 against the arm 63 of bell crank 57. As the bolt retracts, the toggle linkage 30 moves inwardly toward the door 20 which causes the block 50 to both rotate on pivot pin 34 and slide upward due to a restraint on the motion of the block caused by rod 52 which is secured to the arm 56 of bell crank 57. As the block 50 moves inwardly, slides upwardly and rotates, the rod 52 causes the bell crank 57 to rotate in the counter-clockwise direction of arrow 70. Rotation of the bell crank 57 lifts the piston 67 to move hydraulic fluid within the upper part of cylinder 46 through an outlet tube 73 and into the throttling and control, hydraulic circuit 45. From the hydraulic circuit 45 the fluid returns to the lower portion 78 of the cylinder 46 via line 75.

The throttling circuit includes a check delay valve 80 and a normally open valve 81, which is held normally open by a solenoid 85. As long as the solenoid 85 is energized, the normally open valve 81 will be closed forcing the fluid through the check delay valve 80. The check delay valve 80 throttles fluid as it flows from line 73 to line 75. In the preferred embodiment, this delay is for a period of approximately thirty seconds before the door 20 opens as long as the solenoid 85 is energized to keep the valve 81 closed. When the valve 81 is opened, then fluid in line 73 will pass through the valve 81 to line 75 and allow the door to open immediately because the fluid is able to bypass the throttle 80.

The coil 86 of the solenoid 85 is connected at one end to an emergency situation control circuit 100 and at the other end to a timing circuit 101. The emergency situation circuit includes a power supply 102, a central station control panel 103 (which preferably includes switches for de-energizing solenoid 85 remotely), fire boxes 104 and smoke detectors 105. These elements are connected in series with a drop-out relay 106 which includes a manual reset switch 107. If either the fire boxes 104 or smoke detector 105 indicate an emergency condition, the drop-out relay 106 will be opened to cut off power from the power supply 102 to the solenoid 85. The solenoid 85 will then allow normally open valve 81 to open so that the fluid in line 73 need not be throttled by the check delay valve 80 in order to flow to line 75 and lower chamber 78 of cylinder 46. Accordingly, the door 20 will open immediately if an emergency condition is sensed or if, for any reason, power to the solenoid 85 is interrupted. The manual reset switch 107, which can be located at the central station 103, must be operated in order to reclose the drop-out relay 106. If an emergency condition persists, then the manual reset 107 cannot reset drop-out relay 106. A visual indicator 108 in the form of a light is provided at the central station 103 and perhaps adjacent to the door 20 so as to indicate whether the door is operating in an emergency mode or in a delay mode.

The solenoid 85 is attached to ground through the emitter of a transistor 110 located in timing circuit 101. Normally, the transistor 110 is switched on so as to conduct power from power supply 102 to ground. However, when the transistor 110 is switched off, solenoid 85 is no longer energized and normally open valve 81 will open. The timing circuitry 101 includes a three-to-five second timer 115 which is preferably set at five seconds; a fifteen to thirty second timer 116, which is preferably factory set, and a ten second timer 117, which triggered by the timer 116 to turn off transistor 110 for a period of ten seconds. The timers operate in series and are connected to a microswitch 120 that is operated by an arm 121 which is pressed by spring 122 into engagement with link 62 upon which the latch bolt 26 is pivoted. Upon pushing the door 20, toward the open position, the latch bolt 26 is cammed by the strike 23 toward the retracted position, carrying the link 62 back. After a slight movement of the bolt 26, the arm 121 moves off of the link 62 and closes the microswitch 120 which starts the timer 115 and lights visual indicators 125 which may be at the central station 103 or perhaps at the door 20. The switch 120 also energizes an audio indicator or alarm 126 located adjacent the door 20 so as to indicate to the person trying to open the door and others in the vicinity of the door that the door has been tampered with. If desired, an audio indicator 126 may also be located at the central station 103.

Upon closing the switch 120, the first timer 115 is started and counts a time interval with a preferable duration of five seconds. If the push bar 37 is released or if pressure on the door ceases before the five second interval expires, then the timer 116 is reset and will start all over again if the bar 37 is thereafter pressed. If either door 20 or the bar 37 are pressed for five seconds, then the first timer 115 triggers the second timer 116 which runs for a period of fifteen to thirty seconds, the period being determined at the factory or during installation. The timer 116 cannot be stopped or reset after being started. Upon expiration of the time interval (preferably thirty seconds) which interval is programmed into the second timer 116, the second timer triggers the third timer 117 which interrupts power to the base of transistor 110 for an interval of ten seconds. When the transistor 110 is turned off, solenoid 85 will be de-energized and normally open valve 81 will open allowing the door 20 to open immediately. During this ten second interval, the door may be opened and closed without the necessity of waiting for the time sequence. Moreover, after the ten second interval has expired, the door may be held open indefinietly, but once the door is allowed to close, the timing sequence must be reinitiated.

The electronic timing system operates in parallel with the hydraulic system so as to provide a fail-safe arrangement so that if the hydraulic system does not operate the electronic system will operate, and if the electronic system 101 fails for some reason the hydraulic system will still allow the door 20 to open. It is emphasized that the combination of the hydraulic system and electrical system provides isolation between the solenoid 85 and the mechanical forces transmitted through the bolt 26 into the latching and locking apparatus 25. Accordingly, the system will not jam due to mechanical forces preventing the emergency solenoid 85 from operating. Since the solenoid 85 merely allows the normally open valve 81 to open, a system with a very quick response is achieved whereby after the selected time interval, the door 20 will open immediately.

It is to be kept in mind that the system will operate without the throttling feature of the delay check valve 80. If, for example, it is desired to have a door securing system in which the securing member does not mechanically move until after the selected or desired time interval has expired, then the fluid in the fluid circuit can be prevented from moving as long as the normally open valve 81 is closed. Immediately upon opening the valve 81, the fluid can move from one side of the piston 67 to the other, thereby allowing the door 20 to open.

In the embodiment in which the delay check valve 80 is deleted, the latch bolt 26 does not move at all after the toggle 30 is broken. Consequently, the door 20 will remain tightly shut within the door frame 21 and the width of the space between the door and door frame will not change during the delay. Depending on the design of the door 20, this can be important because if the width of the space is too great, then a fire within the building can be fed with a stream of air coming in around the door 20 during the delay.

In essence, the locking and latching apparatus 25 is one embodiment of a securing means which prevents the door 20 from opening when in a first mode and allows the door to open when in a second mode. Transition between the first and second modes is effected by expiration of the delay interval provided by the timing circuit 101; by operation of at least one of the components 103, 104 or 105 of the emergency circuit 100, or by throttling enough fluid through the check delay valve 80 to permit the bolt 26 to retract. If an abrupt change is desired after the delay, then the check delay valve 80 can be eliminated as suggested in the previous paragraph.

Figure 3:
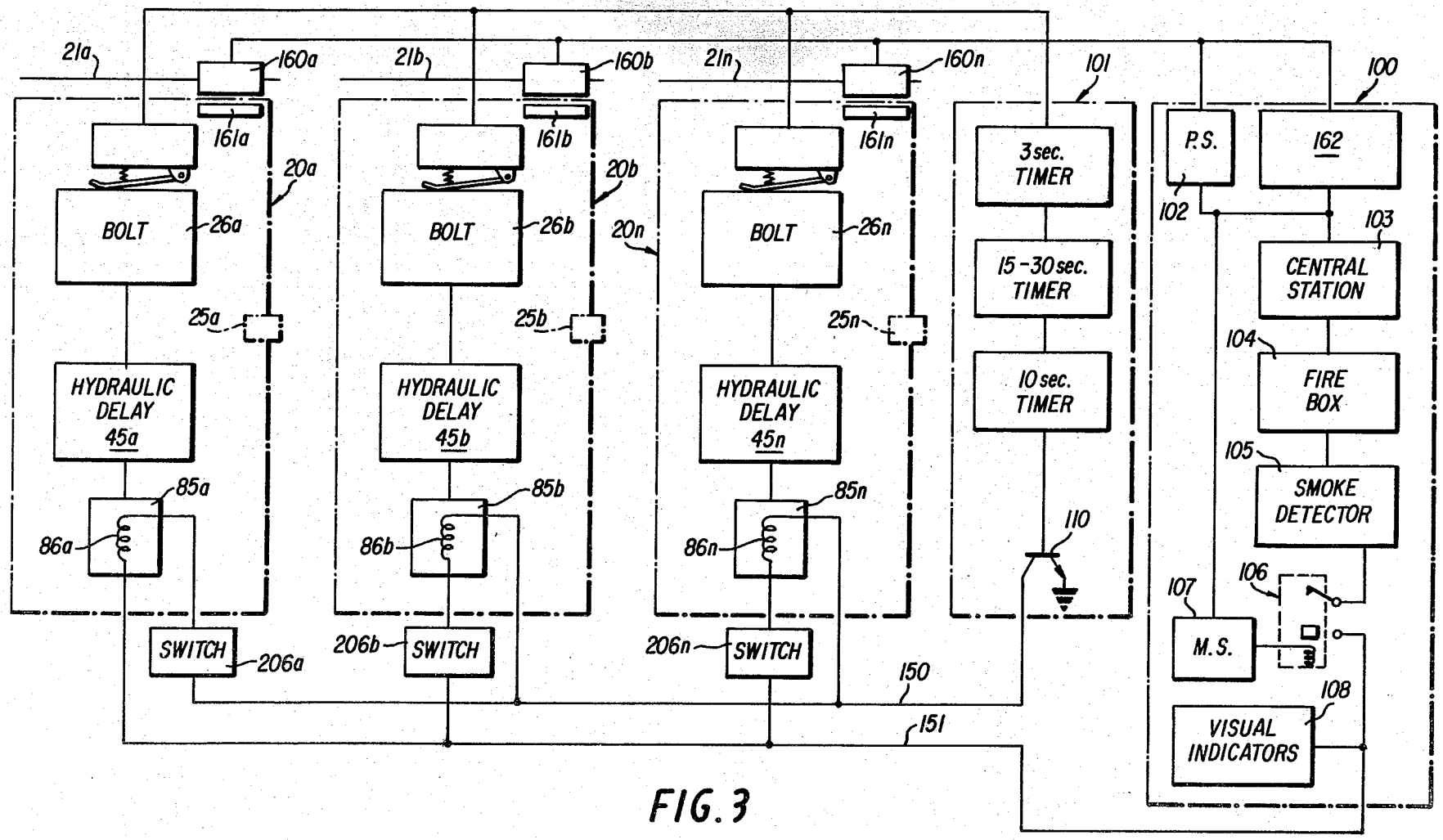
FIG. 3 is a diagrammatical view of a system which utilizes a single electronic timing system to delay the opening of a plurality of emergency exit doors.

Referring now to FIG. 3, there is shown an embodiment of the invention wherein a plurality of doors represented by numerals **20*a*–20*n* are connected to a single timing circuit 101 and a single emergency situation control circuit 100. The doors 20*a*–20*n* are each equipped with a separate securing means or latch 25*a*–25*n* such as the latch 25 shown in FIG. 1. Each of the latches 25*a*–25*n* includes the hydraulic circuit 45 shown in FIG. 2 which is opened by a normally open valve 81 held closed by solenoid 85 upon energizing the coil 86** in the solenoid.

In FIG. 3, coils **86*a*–86*n* of solenoides 85*a*–85*n* are in parallel across line 150 from the collector of transistor 110 and line 151 connected to the emergency situation control circuit 100. Accordingly, when the transistor 110 interrupts current from the power supply 102, which is preferably located in the circuitry 100, all of the doors 20*a*–20*n* are allowed to open although only one of the switches 120*a*–120*n* has been activated. Consequently, if the doors 20*a*–20*n* are arranged in banks of perhaps 5 to 20 doors at one location in a building, then all of the doors will be released simultaneously upon pressing the emergency operating bar 37** of only one door.

It should be kept in mind that all of the doors **20*a*–20*n* remain latched even when the latches are in a quick opening mode and then, after the ten-second reset time, the doors are again secured. Each of the doors 20*a*–20*n* in the bank is individually openable after the time interval determined by its own hydraulic delay circuit 45. Consequently, the redundancy or override feature in the embodiment of FIG. 2 is also provided in the embodiment of FIG. 3**.

While the emergency situation control circuit 100 is shown operating one bank of doors in FIG. 3, it should be kept in mind that the same emergency circuitry can be used to operate numerous banks of doors, if necessary or desired. If, for some reason, individual banks of doors or groups of individual banks of doors need separate emergency situation control circuits 100, then separate circuits can be provided. To a large extent, this depends on the configuration and need of the building in which the system is employed.

As with the arrangement of FIG. 1 for a single door, the electronic timing circuitry 101 can be set for a relatively short delay of perhaps 15 to 30 seconds after a serious attempt to open the door is indicated by one of the switches **120*a*–120*n* while the hydraulic delay circuitry 145*a*–145*n*** can be set with a delay interval which is perhaps 15 seconds longer.

In monitoring the condition of the doors **20*a*–20*n* or even of a single door, it is necessary to provide a separate indicator explaining whether each door is open or closed. This cannot be determined by the position of the bolt 25 since, if the door is open and the bolt is projected, the switches 120*a*–120*n*** indicate to a remote station that the door is secure.

The conditions of the doors **20*a*–20*n* are monitored by magnetic reed switches 160*a*–160*n* mounted in the door jambs 21*a*–21*n* within which the doors are mounted. Permanent magnets 161*a*–161*n* are mounted within the edges of the doors 20*a*–20*n* to keep the magnetic reed switches closed. When one of the doors 20*a*–20*n* is opened, the associated magnetic reed switch is opened which activates remote indicator 162*a*–162*n* at the security station. The indicators 162*a*–162*n*** can have both visual and audible signals.

The structure and circuitry set forth in FIGS. 1–3 is generally concerned only with operating the emergency exit door 20 or doors 20A–20N from the inside. In essence, the doors 20 are latched with respect to the inside and locked with respect to the outside. FIGS. 4–8 show an arrangement in combination with the lock 25 for accomplishing outside operation.

As is seen in FIGS. 1, 2, 4 and 5, the toggle 30 has a sliding link 200 which overlies it and hooks it with a tab 201. It is readily seen that if the sliding link 200 is slid to the right in FIG. 4, it will break the toggle 30 by pulling the toggle over center so as to undog bolt 36. The sliding link 200 therefore performs essentially the same function as panic bar 37. Once the toggle 30 is pulled over center, then the door 20 can be opened by pulling on the exterior handle 205.

Figure 4:
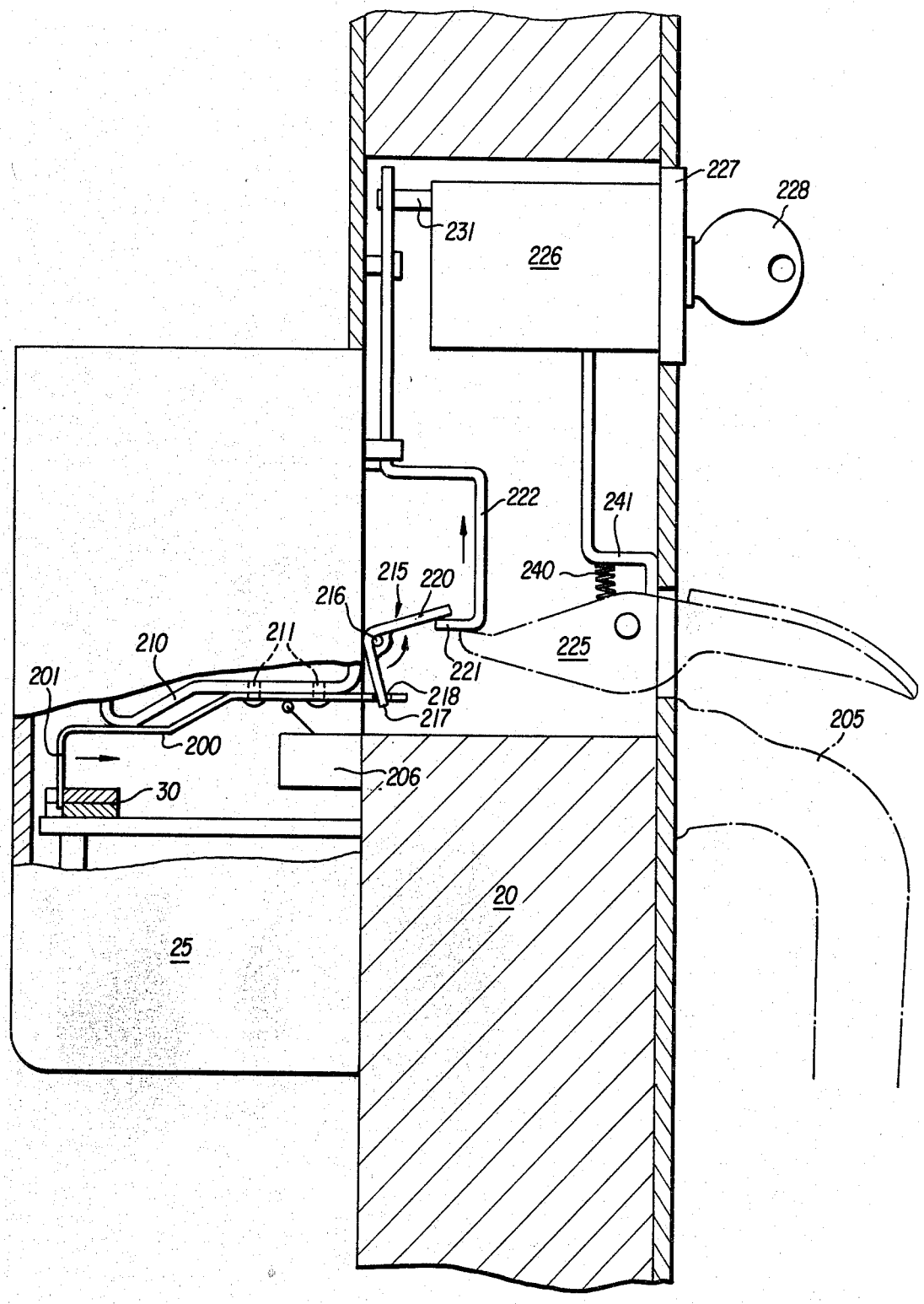
FIG. 4 is a side elevation of the exterior unlocking and unlatching apparatus of the instant invention showing the latch of FIG. 1 being unlatched by a thumb-operated latch lever.

As best seen in FIG. 4, the sliding link 200 also opens a switch 206 (see also FIGS. 2 and 3) which opens the line connecting the coil 86 of the solenoid 85 to the timing circuit thereby allowing valve 81 to open so that hydraulic fluid is not throttled by the throttle 80 (see FIG. 2). Accordingly, the door can be immediately opened by pulling the handle 205 or a similar handle once the delay is deactivated by bypassing throttle 80 (see FIG. 2).

The link 200 is mounted on a bracket 210 by a pair of rivets 211 which are received in a slot in the link 200 and allow the link to slide. A bell crank, designated generally by the numeral 215, is pivoted on a pivot 216 and has a first arm 217 received through a hole 218 in the sliding link 200. Bell crank 215 has a second arm 220 which is engaged by a tab 221 on an interposer 222 so as to be rotated in the counterclockwise direction with respect to FIG. 4 and thereby draw the sliding link 200 to the right so as to break the toggle 30.

Figure 6:
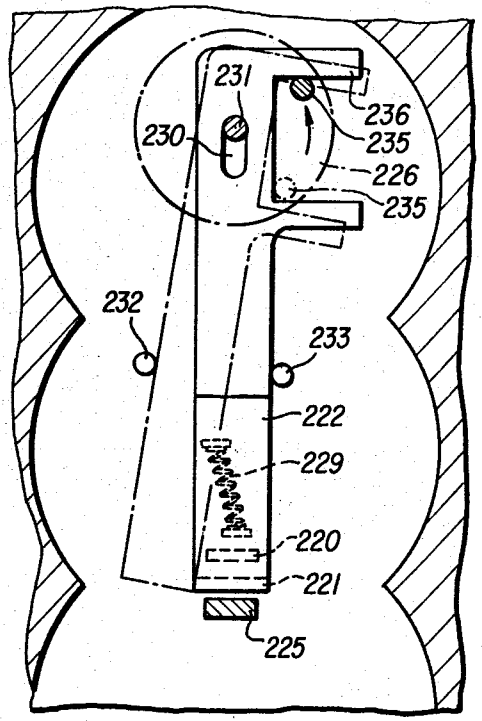
FIG. 6 is a cross-section taken normal to FIG. 3 showing movement of an interposer between a locked position, shown in dotted lines, and a latched position shown in solid lines.
Figure 5:
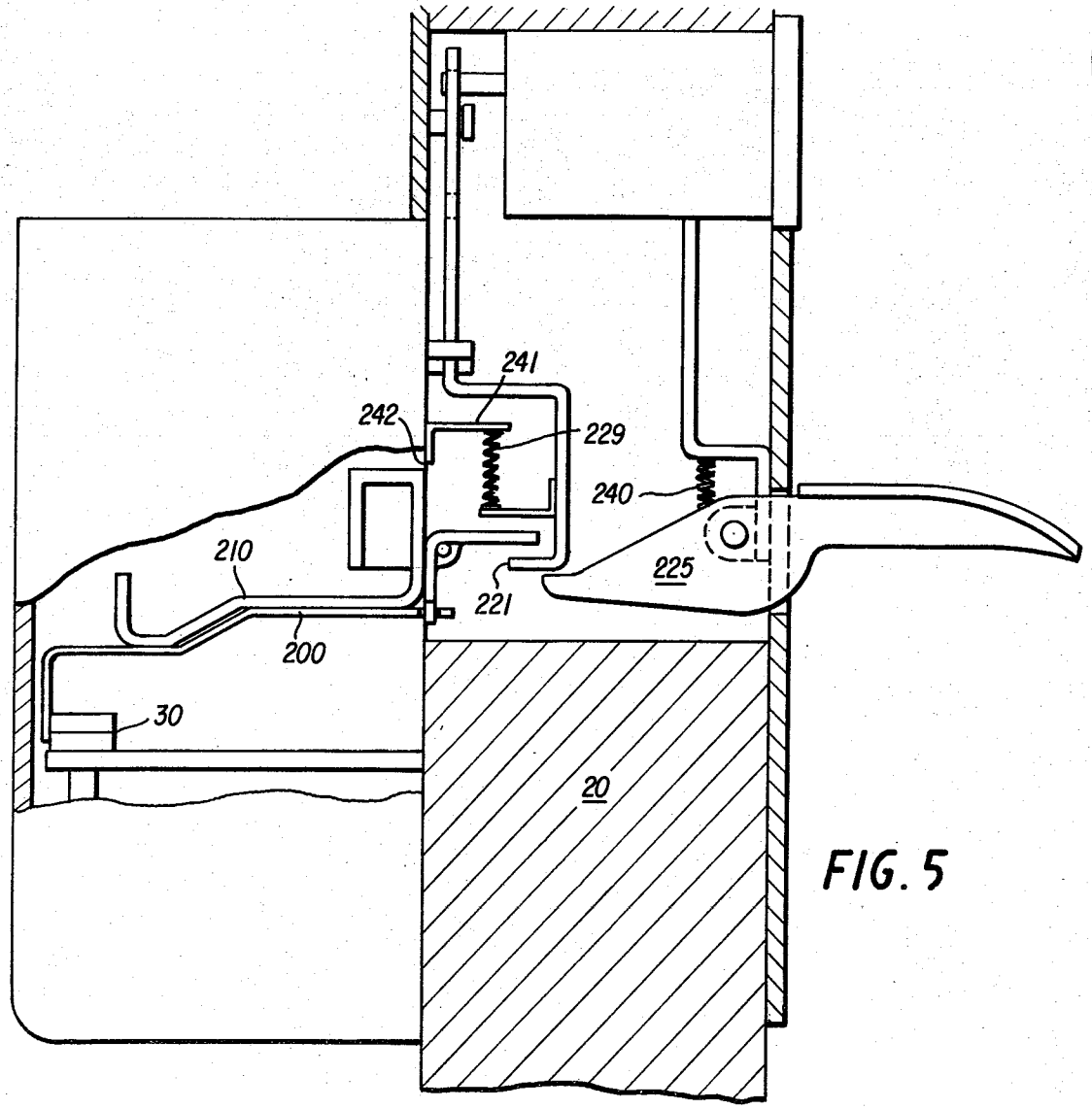
FIG. 5 is a cross-section of the locking and unlatching apparatus according to the instant invention showing the latch of FIG. 1 prior to unlatching.
Figure 8:
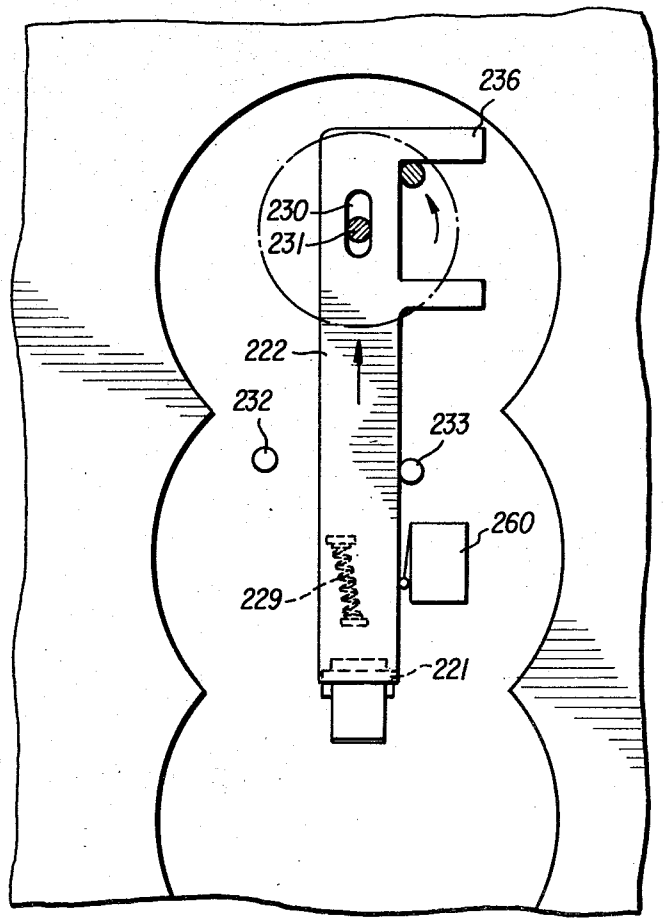
FIG. 8 is a cross section similar to FIG. 6 showing the door being unlatched by rotation of the tumbler.
Figure 7:
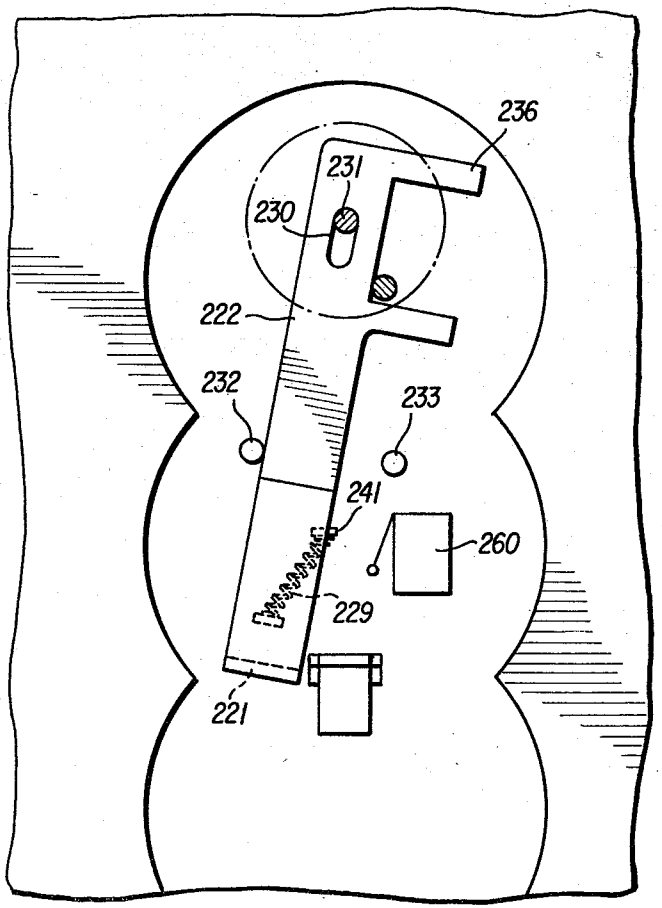
FIG. 7 is a cross section similar to FIG. 6 showing the interposer positioned so as to leave the door locked.

The interposer 222 may be lifted either by rotating a thumb latch lever 225 or a tumbler 226 of a lock 227 rotated by the key 228. As is seen in FIGS. 6, 7 and 8, the interposer 222 is shiftable overcenter against the bias of spring 229 into a position in which the tab 221 is aligned with the second arm 220 of the bell crank in order to permit opening of the door from the outside. In order to lock the door, the interposer is shifted to a position (dotted in FIG. 6) in which the tab 221 is out of alignment with the arm 220 in which the case the door cannot be opened from the outside. The interposer 222 has a slot 230 at the top end thereof into which is received a pin 231 on the tumbler 226. A pair of pins 232 and 233 are positioned on opposite sides of the interposer 222 to restrain the motion thereof between the locked position (dotted line in FIG. 6) and operable position (solid line in FIG. 6).

In order to move the interposer 222 from the dotted line to the solid line position in FIG. 6, the tumbler 226 is rotated by the key 228 so as to move a stop pin 235 from a dotted line position to a solid line position. The pin 235 engages a leg 236 on the interposer 222 in order to rotate it in the counterclockwise direction in FIG. 6 to thereby shift the interposer 222 from the FIG. 7 position to the FIG. 6 solid line position. When the interposer 222 is in the FIG. 6 solid line position, the interposer is restrained from further rotation in the counterclockwise direction because it engages the pin 233. Consequently, continued rotation of the tumbler 226 causes the pin 235 to lift the interposer 222 from the FIG. 6 position to the FIG. 8 position and thus rotate the bell crank 215 in the counterclockwise direction (FIG. 4), thereby pulling the sliding link 200 to the right in FIGS. 4 and 5, breaking the toggle 30 and undogging the latch bolt 26. Thereafter, by pulling on the handle 205, the door 20 will open.

In many situations, use of the thumb latch lever 225 will be desirable either in lieu of the movement of stop 235 from the FIG. 6 to the FIG. 8 position or in addition to that movement. The tab 221 projecting from the interposer 222 extends across a gap between the end of the latch lever 225 and the second arm 220 of the bell crank. When the interposer is in the dotted line position of FIG. 6 or the position of FIG. 7, the thumb latch lever 225 cannot transmit its force to the bell crank 215. However, when the interposer is shifted to the solid line position of FIG. 6, the thumb latch lever 225 transmits its force through tab 221 to the arm 220 so as to rotate the bell crank 215 in the counterclockwise direction and undog the latch bolt 26.

A spring 240 positioned between the latch lever 225 and a flange 241 projecting from the supporting casing of the mechanism urges the latch lever counterclockwise so that it is lower than the arm 220 of the bell crank 215 whereby the tab 221 on the interposer can be shifted in and out of alignment with the gap between the end of the latch lever 225 and the second arm 220 of the bell crank 215.

As is seen in FIGS. 7 and 8, interposer 222 can operate a switch 260 which opens the line 261 to the aural indicators 126 so that when the door is unlocked from the outside, no audible signal is sounded. If desired, the switch 260 can be manually or remotely deactivated so that there will be an audible signal if the door is unlocked from the outside. Preferably, visual indicators 123 and 108 will remain active so that unlocking of the doors 20 or doors **20*a*–20*n*** will be at least visually discernable both locally and at remote monitoring stations.

The foregoing embodiments and examples are for illustrative purposes only, the invention being limited only by the following claims:

What is claimed is:

1. In combination:

a latch bolt for securing an emergency exit door when the bolt is projected;

a toggle linkage connected to the latch bolt for holding the latch bolt in the projected position when in a dogging mode and for allowing the latch bolt to move to the retracted position when in an undogging mode, wherein the undogging mode is over center from the dogging mode;

a sliding link in engagement with the toggle linkage for shifting the toggle linkage from the dogged mode to the undogged mode upon sliding from a first position to a second position;

a bell crank having one arm connected to the slider for sliding the slider from the first position to the second position upon rotating the other arm of the bell crank;

an interposer positioned adjacent to the other arm of the bell crank and means for mounting the interposer to shift in and out of alignment with the bell crank;

a lock, including: a rotatable tumbler and means on said tumbler for engaging said interposer to move said interposer into alignment with said second arm of said bell crank for unlatching the door from the outside and for moving said interposer out of alignment with said second arm of said bell crank for preventing unlatching of the door from the outside;

means accessible on the outside of the door and in engagement with the interposer to move the interposer against the second arm of the bell crank and to thereby cause the slider to move the toggle from the dogged to the undogged mode, and said latch bolt being connected to a delay means for retarding retracting of the latch bolt and further including means for deactivating delay means whereby the latch bolt retracts without delay upon operating the outside operating means.

2. The combination of claim 1 wherein the outside operating means includes a thumb operated latch lever pivoted with respect to the door which when depressed moves the interposer from the first position wherein the door is latched to the second position wherein the door is unlatched.

3. The combination of claim 1 wherein the outside operator includes:

means connected between the tumbler means and interposer for moving the interposer from the unaligned position to the position upon rotating the tumbler past the position where the interposer is aligned with the bell crank.

4. The combination of claim 1 or 3 wherein the outside operating means includes:

a thumb operated latch lever pivoted with respect to the door which when depressed moves the interposer from the first position wherein the door is latched to the second position wherein the door is unlatched; and wherein the outside operator includes:

means connected between the tumbler means and interposer for moving the interposer from the first position to the second position upon rotating the tumbler past the position where the interposer is aligned with the bell crank.

5. The combinations of claims 2 or 3 wherein the means for connecting the interposer to the tumbler includes a slot in the interposer and an axial pin projecting from the tumbler registering with the slot in the interposer and a first pin displaced from the axis of the tumbler for engaging the interposer to pivot the interposer about the axial pin into alignment with the bell crank and a second axial pin for engaging the interposer on its opposite side to move the interposer to the second unaligned position, and means for restraining the interposer to sliding motion after the interposer has become aligned with the bell crank.

6. The combination of claim 1 wherein the latch bolt is connected to a delay means for retarding retracting of the latch bolt and further including means for deactivating the delay means whereby the latch bolt retracts without delay upon operating the outside operating means.

7. The combination of claim 6 wherein the delay means include a hydraulic circuit with throttling means therein and means connected to the bolt for moving fluid in the circuit through the throttling means and further includes solenoid operating means for bypassing the throttling means, the deactivating means being a switch for opening the bypass valve by de-energizing the solenoid.

8. The combination of claim 6 further including an alarm means connected to the latch bolt for sounding when the bolt retracts and means for disenabling the alarm means upon unlocking the lock from outside of the building.

* * * * *